United States Patent [19]

Maye

[11] 3,971,527

[45] July 27, 1976

[54] YARN REEL

[76] Inventor: Robert Maye, 7 Wildwood Gardens, Port Washington, N.Y. 10033

[22] Filed: Mar. 14, 1975

[21] Appl. No.: 558,352

[52] U.S. Cl. ..... 242/118.7; 242/50; 242/222

[51] Int. Cl.[2] ..... B65H 54/68; B65H 75/06; B65H 75/14

[58] Field of Search ..... 242/61, 118.6, 118.7, 242/118.8, 222, 50

[56] References Cited

UNITED STATES PATENTS

| | | | |
|---|---|---|---|
| 2,781,985 | 2/1957 | Hoffstedt | 242/118.6 |
| 2,824,706 | 2/1958 | Rosset et al. | 242/118.7 |
| 2,981,406 | 4/1961 | Clark, Jr. | 242/222 |
| 3,780,855 | 12/1973 | McLeod et al. | 242/222 |

*Primary Examiner*—Leonard D. Christian
*Attorney, Agent, or Firm*—Pasquale A. Razzano

[57] ABSTRACT

A reel for yarn, ribbon, or the like is disclosed which consists of a pair of end pieces and a central web operatively connected therebetween about which the yarn or ribbon can be wound. The end pieces are of identical construction and each comprises a single blank of foldable material having a central section, at least two intermediate sections respectively joined to two sides of the central section along fold lines therebetween, and two end sections respectively associated with the intermediate sections along additional fold lines therebetween. The central section has at least one slot formed therein which receives the end flanges in the folded configuration of the end pieces. The intermediate sections are folded through approximately 180° over the central section about the fold lines therebetween and the end sections of the blank are folded through approximately 90° about the fold lines between the end sections and their associated intermediate sections to extend through the slot or slots in the center section, for attachment to the central web of the reel.

25 Claims, 7 Drawing Figures

YARN REEL

The present invention relates to yarn reels or spools, and more particularly to a yarn reel having end pieces or flanges formed from single sheets of foldable material.

Spools and reels for yarn, ribbon, fabric, wire and other windable materials have been previously proposed in a numerous variety of configurations and constructions. Typically, such reels are formed from plastic, wood, or paper materials and include end pieces or side flanges and a central portion of web about which the material is wound. With the continuing increase in costs for such materials it is necessary to form such spools and reels as inexpensively as possible and with a minimum amount of manual labor. At the same time it is required that the spools or reels retain an optimum strength for the use intended.

Accordingly, it is an object of the present invention to provide a reel which is durable and yet inexpensive in construction.

Another object of the present invention is to provide a yarn spool or reel which is readily assembled with a minimum of manual operation.

A further object of the present invention is to provide a spool or reel having end pieces which are formed from single blanks of material folded to allow connection of the end pieces to a central spacer or web about which the material is to be wound.

In accordance with one aspect of the present invention a reel on which yarn, ribbon or other flexible materials can be wound includes a pair of end pieces or end flanges and a central spacer member or web operatively connected therebetween about which the material can be wound. In particular, the end pieces are each formed from a single piece of foldable material having a generally rectangular central section that includes a pair of parallely extending long sides and a pair of parallely extending short sides. A pair of spacer sections are respectively joined to the long sides of the central section of the end piece along first fold lines formed therebetween and a pair of generally trapezoidally shaped intermediate sections, having parallely extending long and short sides, are respectively joined to the spacer sections along second fold lines formed therebetween. Finally, a pair of end sections are respectively joined to the intermediate sections along third fold lines between the end sections and the short sides of the intermediate sections. The spacer sections of the end pieces are folded substantially perpendicularly to their associated central section along the first fold lines, while the intermediate sections are folded substantially perpendicular to the spacer sections along the second fold lines and towards each other over the central section of the end piece. The end sections are then folded substantially perpendicularly to the intermediate sections along the third fold lines, towards the central section and extend through a slot or slots formed in the central section in positions substantially parallel to the spacer sections. The folded end sections of the respective end pieces are positioned towards each other and interconnected to the central spacer member or web to form the completed reel assembly.

The above, and other objects, features and advantages of the present invention, will be apparent in the following detailed description of an illustrative embodiment thereof, which is to be read in connection with the accompanying drawings wherein.

Figure 1:
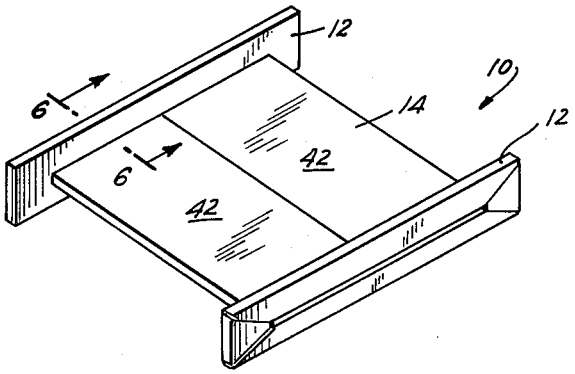
FIG. 1 is a perspective view of a reel assembly constructed in accordance with the present invention.

Referring now to the drawing in detail, and initially to FIG. 1 thereof, a reel 10 is provided on which a flexible material such as yarn or ribbon can be wound. The reel includes a pair of substantially identical end pieces of flanges 12 and a central member or web 14 about which the material is wound.

Figure 2:
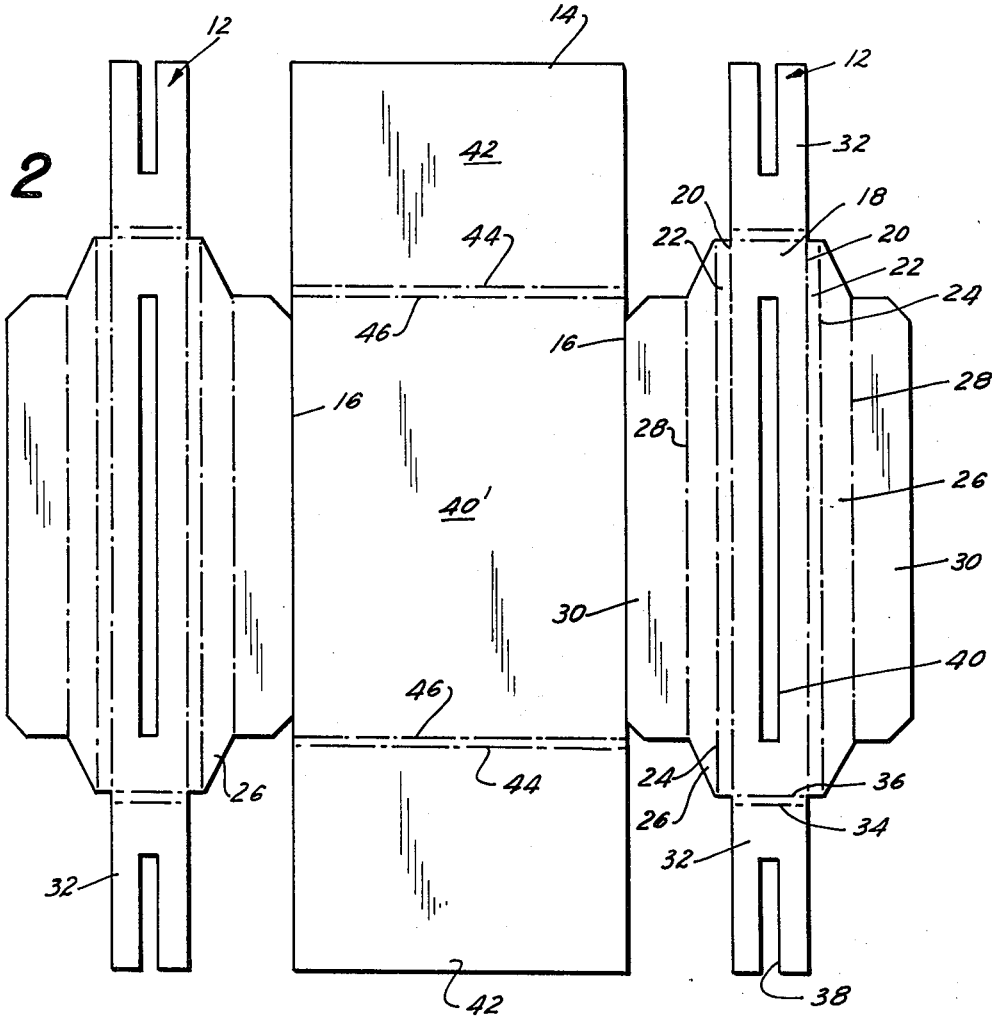
FIG. 2 is a plan view of the unfolded end piece and central web elements of the reel in FIG. 1.

The end pieces 12 and central web 14 of reel 10 are formed from a foldable material, such as for example cardboard or corrugated paper board. In one embodiment of the invention each of the elements are simultaneously cut from a single piece of the cardboard or corrugated paper board material to have a contiguous connected peripheral configuration as illustrated in FIG. 2. As seen therein, the central web 14 has a generally rectangular configuration while the end piece blanks 12 have identical polygonal configurations. This single sheet of peripherally cut material is then cut, again, along the lines 16 to separate the end pieces from the central web 14. Alternatively, the end piece blanks 12 can be cut, for example by die cutting or the like, from separate sheets of material.

In either case, the configuration of the end pieces 12 is selected such that each end piece has a central section 18 of generally rectangular configuration bounded by a pair of first fold lines 20 along its long sides. These fold lines can be scored into the cardboard or corrugated paper board material in the conventional manner. A pair of spacer sections 22, also of rectangular configuration, are provided adjacent the central section 18 along the first fold lines 20. The length of the spacer sections 22 is equal to the length of the central section 18.

The spacer sections are defined between the first fold lines 20 and a second set of fold lines 24 formed in the end piece 12. The fold lines 20, 24 extend parallel to each other and are spaced a distance equal to or slightly greater than the thickness of the blank material from which the end piece is formed.

Intermediate sections 26 are defined on the end pieces 12 between the second fold lines 24 and a third pair of fold lines 28. As seen most clearly in FIG. 2, the intermediate sections 28 each have a generally trapezoidal configuration and include a long base positioned along the fold lines 24 and a parallely extending short base along the fold lines 28. The height of the trapezoid, i.e. the distance between the long and short bases, is approximately equal to one half of the width of the center section 18, as will become apparent hereinafter.

The end pieces 12 are also provided with end sections 30 of generally rectangular configuration joined to the intermediate sections 26 along the third fold lines 28. The length of these end sections is substantially equal to the length of the short base of the trapezoidal intermediate sections 26.

Finally, end pieces 12 are each provided with reinforcing tabs 32, of generally rectangular configuration, which are joined along the short sides of the rectangular central section 18 by a pair of spaced fold lines 34, 36. These reinforcing tabs have slots 38 cut therein, so that when they are folded over the central section 18, as described hereinafter, these slots register with a slot 40 formed in the central section 18, to provide a clear passage through which the end sections 30 of the end piece can be inserted.

Figure 3:
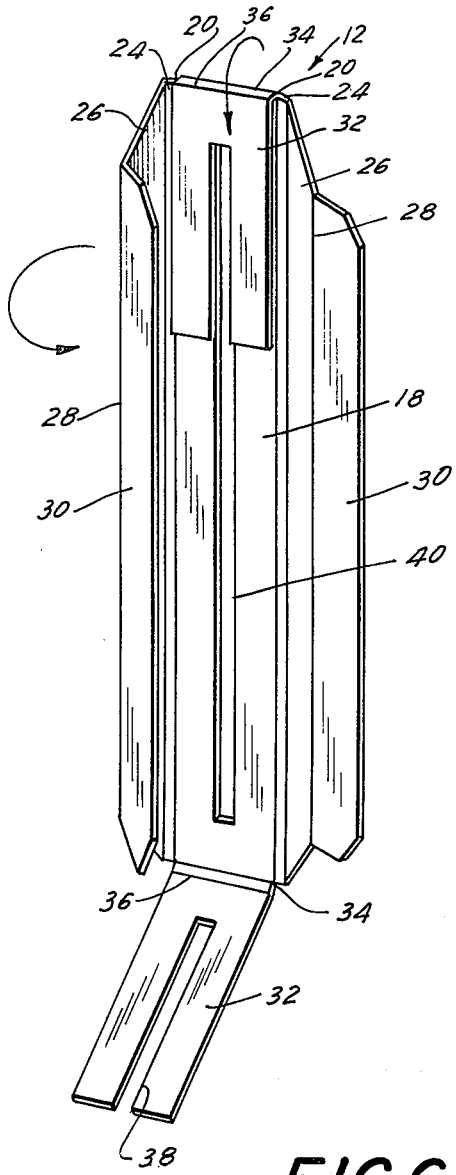
FIG. 3 is a perspective view illustrating an initial folding step performed while folding the end pieces of FIG. 1 to form the completed end piece construction.
Figure 4:
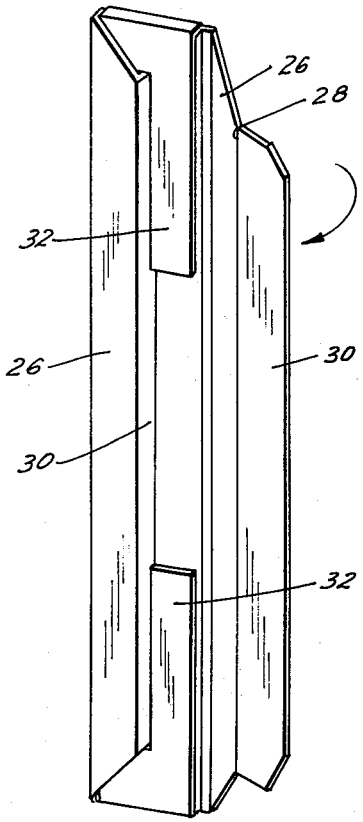
FIG. 4 is a perspective view of a further portion of the folding procedure for the end pieces.

Referring more particularly to FIG. 3 of the drawing, in order to assmble an end piece 12, in its folded configuration, the reinforcing sections 32 are first folded over the central section 18 by bending the reinforcing section through 90° about the fold lines 34 and then another 90° about the fold lines 36. In this manner the reinforcing tabs 32 will overlie the central section 18 with the slots 38 thereof in registry with the slot 40 in the central section. Thereafter, the spacer sections 22 are folded 90° about the fold lines 20 and the intermediate sections 26 are folded through 90° about the fold lines 24. In this manner, the intermediate sections 26 are folded through approximately 180° with respect to the central section 18 to overlie the central section, as illustrated in FIG. 4.

Before the intermediate section 26 is folded, the end sections 30 are folded through 90° with respect to the intermediate sections 26 about the third fold lines 28. Thus, when the intermediate sections 26 are folded through 180°, as described above, the end sections 30 will be inserted through the slots 38, 40 in the tabs 32 and the central section 18. In this connection it is noted that the length of the slot 40 in the central section 18 should be at least as long as the length of the end section 30 in order to permit this insertion.

Figure 5:
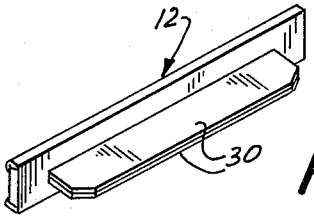
FIG. 5 is a perspective view, on a reduced scale, of the completely folded end piece.
Figure 6:
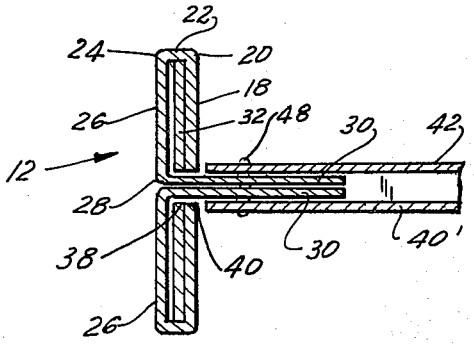
FIG. 6 is a sectional view taken along line 6-6 of FIG. 1.

By folding the end piece 12 in this manner, it will have a configuration as illustrated in FIG. 6, wherein it is seen that the end sections 30 of the end piece or blank 12 will extend through the slots 38, 40 from one side of the end piece to the other. In this configuration the reinforcing tabs 32 are located between the central section 18 and the intermediate section 26, so that the end piece 12 has three layers of material across a major portion of its length, to provide substantial strength to the end piece during use of the assembled reel. Of course, since both end pieces 12 are of identical construction, they will both be folded in the same manner to produce the same configuration as that of the end piece illustrated in FIGS. 5 and 6.

In order to assemble the reel, two folded end pieces are placed in juxtaposition with their end sections 30 facing each other. The central web portion 14 is then positioned between the end pieces and secured to their end sections 30. In the illustrative embodiment of FIG. 2, the central web 14 consists of a main body portion 40 and two flaps 42 joined to the main body portion along two fold lines 44, 46. These end flaps have a length which is substantially equal to one half of the length of the central section 40, so that when they are folded over the central section 40, by folding through 90° respectively; about each of the fold lines 44, 46, they will completely cover the central section, as illustrated in FIG. 1, so that the central web 14 has a double layered thickness to improve its strength.

In assembling the reel, the endpieces 12 are first positioned with their end sections 30 overlying the central section 40 of web 14, and then the end sections 42 are folded over the end sections 30 to completely surround and enclose those end pieces, as illustrated in FIG. 6. Thereafter, the web 14 can be firmly secured to the end sections 30, and thus to the end pieces 12, by staples 48, or by an adhesive material.

Figure 7:
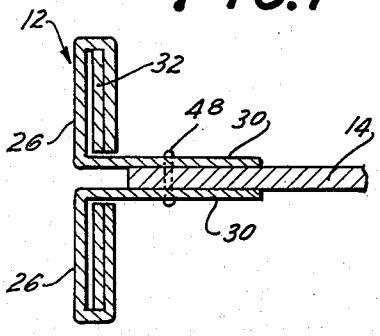
FIG. 7 is a sectional view, similar to FIG. 6, of another embodiment of the present invention.

In another embodiment of the present invention, in lieu of the foldable central web 14, a single flat piece of paper board, wood or plastic, can be used as the web. In this embodiment, as illustrated in FIG. 7, the single piece central web 14 would have a length substantially equal to the length of the end sections 30 of the end pieces and would be positioned between the end sections 30 and stapled thereto by staples 48. Alternatively, of course, the single sheet web 14 of the FIG. 7 embodiment, could be secured to the end sections 30 by an adhesive, or by stitching.

It is noted that in the illustrative embodiment of the invention, only a single slot 40 has been provided in the central section 18 in order to accommodate both of the end sections 30 of the end piece 12. However, it will be appreciated that separate slots can be provided for each of the end sections if desired. This may be advantageous in an embodiment such as FIG. 7 wherein the end sections 30 will be spaced from one another due to the positioning of the central web 14 therebetween. Additionally, it is noted that the illustrative embodiment of the invention utilizes a central section which is generally rectangular in configuration, in order to form a rectangular end piece. However, it will be appreciated that the central section 18 can have a generally triangular or other polygonal configuration, with intermediate and end sections 26,30 joined thereto along fold lines in the same manner as that described with respect to the rectangular end section described above. In that case, the central section would have individual slots 40 formed therein parallel to each of its sides from which an intermediate and end section extend in order to accommodate the end sections when the end piece is folded.

Accordingly, it will be appreciated that a reel for yarn, ribbon or the like is provided which has a relatively simple construction, and which will be inexpensive to manufacture. Moreover, by the folding arrangement for the end pieces, each end piece will be reinforced by having three layers of the paper board or corrugated board material from which it is formed extending along substantially its entire length. This provides a quite strong end flange for a reel structure. Moreover, the folding arrangement provided herein permits a relatively simple operation to be performed in order to secure the end pieces to the central web of the reel.

Although an illustrative embodiment of the present invention has been described herein with reference to the accompanying drawing, it is to be understood that the invention is not limited to those precise embodiments, and that various changes and modifications may be effected therein by one skilled in the art without departing from the scope or spirit of this invention.

What is claimed is:

1. A reel for yarn, ribbon and the like which consists of a pair of end pieces and a central member operatively connected therebetween, said end pieces each comprising a single blank of foldable material having a central section, a pair of intermediate sections respectively joined to opposite sides of said central section along at least one fold line and a pair of end sections respectively joined to its adjacent intermediate section along a fold line extending generally parallel to the fold line between its adjacent intermediate section and said central section; said central section having a slot formed therein for receiving said end flanges; said intermediate sections being folded through approximately 180° over said central section about the fold lines therebetween and said end sections being folded through approximately 90° about the fold lines joining them to their associated intermediate sections and extending through the slot in said central section; said central member being connected to the end sections of the respective end pieces to form said reel.

2. The reel as defined in claim 1 wherein said central section is generally rectangular in plan; said fold lines between the central section and the intermediate sections being located respectively along two parallel sides of the central section.

3. The reel as defined in claim 2 wherein said intermediate sections are each joined to said central section by a pair of spaced parallely extending fold lines and is folded approximately 90° about each of these fold lines over the central section; said spaced fold lines defining edge spacer sections between the central section and the intermediate sections.

4. The reel as defined in claim 3 wherein said central section includes a pair of reinforcing flaps respectively joined to the other pair of parallel sides of the central section by at least one fold line; said reinforcing flaps being folded over said central section along the fold lines through approximately 180° and being positioned between the central section and the folded intermediate sections to reinforce said end pieces.

5. The reel as defined in claim 4 wherein said reinforcing sections have slots formed therein which are generally complementary to said slot in the central section whereby the end sections can pass through the reinforcing sections and the central section.

6. The reel as defined in claim 4 wherein said spacer sections have a width which is substantially equal to the thickness of said reinforcing sections.

7. The reel as defined in claim 2 wherein each of said intermediate sections has a generally trapezoidal periphery in plan having its larger base extending along the fold line between it and the central section and its smaller base extending along the fold line between it and its associated end section.

8. The reel as defined in claim 7 wherein the length of said longer base is substantially equal to the length of the side of the central section to which it is connected and the length of said small base being substantially equal to the length of said slot.

9. The reel as defined in claim 8 wherein the length of said end sections is equal to the length of said smaller base.

10. A reel as defined in claim 1 wherein said central member comprises a one-piece blank having a central section and a pair of end flaps folded over the central section; said central section of the one-piece blank and said folded over end flaps, receiving therebetween the end sections of said end pieces and being secured thereto to form the completed reel.

11. A reel as defined in claim 1 wherein said central member is a flat sheet of material having a pair of opposed edges respectively received between the end sections of each of said folded end pieces and being secured thereto to form the completed reel.

12. The reel as defined in claim 1 wherein said end pieces are formed of paper board.

13. The reel as defined in claim 12 wherein said paper board compriss corrugated paper board.

14. A reel for yarn, ribbon and the like which comprises a pair of end pieces and a central spacer member operatively connected therebetween said end pieces each being formed of a single piece of foldable material having i. a generally rectangular central section, including a pair of parallely extending long sides and a pair of parallely extending short sides;

ii. a pair of spacer sections respectively joined to the long sides of the central section along first fold lines formed therebetween;

iii. a pair of generally trapezoidally shaped intermediate sections having parallely extending long and short sides respectively joined to said spacer sections along second fold lines between the spacer section and the long sides of the intermediate sections; said second fold lines extending parallel to said first fold lines; and iv. a pair of end sections respectively joined to said intermediate sections along third fold lines between the end sections and the short sides of the intermediate sections;

said central section having an elongated slot formed centrally thereof and extending parallel to said first fold lines; said slot having a length at least as great as the short sides of said intermediate sections; said spacer sections being folded substantially perpendicularly to said central section along said first fold lines; said intermediate sections being folded substantially perpendicularly to said spacer sections along said second fold lines, towards each other and over said central section; said end sections being folded substantially perpendicularly to said intermediate sections along said third fold lines, through the slot in said central section and substantially parallel to said spacer sections; said end sections on the respective end pieces extending towards each other; and being connected to said central spacer member to form the completed reel.

15. The reel as defined in claim 14 including a pair of reinforcing flats respectively joined to the short sides of said central section along fourth fold lines; said reinforcing flaps being folded over said central section along said fourth fold lines through approximately 180° and positioned between the central section and the folded intermediated sections to reinforce said end pieces.

16. The reel as defined in claim 15 wherein said reinforcing sections have slots formed therein which are generally complementary to said slot in the central section whereby the end sections can pass though the reinforcing sections and the central section.

17. The reel as defined in claim 16 wherein said end pieces are formed of corrugated paper board.

18. An end piece for a reel adapted to be wound with yarn, ribon or the like; said end piece comprising a single blank of foldable material having a central section including a plurality of sides; at least two intermediate sections respectively joined to two sides of said central section along fold lines therebetween, and at least two end sections respectively associated with said intermediate sections along fold lines therebetween; said central section having at least one slot formed therein for receiving said end flanges; said intermediate sections being folded through approximately 180° over said central section about the fold lines therebetween and said end sections being folded through approximately 90° about the fold lines between them and their associated intermediate sections and extending through their associated slot in said central section.

19. The end piece as defined in claim 18 including at least one reinforcing section joined to one of the sides of the central section along a fold line therebetween and being folded over said central section through approximately 180° and being positioned between said central section and the folded intermediate sections to reinforce said end piece.

20. The end piece as defined in claim 19 wherein each of said intermediate sections has a generally trapezoidal periphery in plan having its larger base extending along the fold line between it and the central section and its smaller base extending along the fold line between it and its associated end section.

21. The end piece as defined in claim 20 wherein the length of said longer base is substantially equal to the length of the side of the central section to which it is connected and the length of said small base being substantially equal to the length of said slot.

22. The end piece as defined in claim 21 wherein said blank of foldable material comprises corrugated paper board.

23. An end piece for a reel adapted to be wound with yarn, ribbon or the like, said end piece comprising a single piece of foldable material having i. a generally rectangular central section, including a pair of parallely extending long sides and a pair of parallely extending short sides;

ii. a pair of spacer sections respectively joined to the long sides of the central section along first fold lines formed therebetween;

iii. a pair of generally trapezoidally shaped intermediate sections having parallely extending long and short sides respectively joined to said spacer sections along second fold lines between the spacer sections and the long sides of the intermediate sections; said second fold lines extending parallel to said first fold lines; and iv. a pair of end sections respectively joined to said intermediate sections along third fold lines between the end sections and the short sides of the intermediate sections;

said central section having an elongated slot formed centrally thereof and extending parallel to said first fold lines; said slot having a length at least as great as the short sides of said intermediate sections; said spacer sections being folded substantially perpendicularly to said central section along said first fold lines; said intermediate sections being folded substantially perpendicularly to said spacer sections along said second fold lines, towards each other and over said central section; said end sections being folded substantially perpendicularly to said intermediate sections along said third fold lines, through the slot in said central section and substantially parallel to said spacer sections.

24. The end piece as defined in claim 23 including a pair of reinforcing flaps respectively joined to the short sides of said central section along fourth fold lines; said reinforcing flaps being folded over said central section along said fourth fold lines through approximately 180° and positioned between the central section and the folded intermediate sections to reinforce said end pieces.

25. The end piece as defined in claim 24 wherein said reinforcing sections have slots formed therein which are generally complementary to said slot in the central section whereby the end sections can pass through the reinforcing sections and the central section.

* * * * *